US006557323B1

(12) United States Patent
Frey

(10) Patent No.: US 6,557,323 B1
(45) Date of Patent: May 6, 2003

(54) WIPE DOWN BRUSH SYSTEM FOR OVERHEAD STRETCH WRAPPER AND METHOD OF OPERATING THE SAME

(75) Inventor: Michael R. Frey, Coral Springs, FL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/025,666

(22) Filed: Dec. 26, 2001

(51) Int. Cl.[7] ..... B65B 11/04; B65B 13/04

(52) U.S. Cl. ..... 53/399; 53/441; 53/588; 53/556

(58) Field of Search ..... 53/399, 441, 556, 53/587, 588

(56) References Cited

U.S. PATENT DOCUMENTS 4,232,501 A 11/1980 Stackhouse
4,524,568 A * 6/1985 Lancaster et al. ..... 53/556
4,563,863 A 1/1986 Humphrey
4,735,033 A 4/1988 Stackhouse
4,779,396 A 10/1988 Stackhouse
4,955,181 A 9/1990 Casteel
4,995,224 A 2/1991 Yourgalite et al.
5,155,970 A * 10/1992 Moore ..... 53/399

* cited by examiner

*Primary Examiner*—John Sipos
(74) *Attorney, Agent, or Firm*—Schwartz & Weinrieb

(57) ABSTRACT

A wipe-down implement system, for performing a wipe-down operation upon a trailing end portion of a wrapping film wrapped around a palletized load, comprises a support arm pivotally mounted upon a vertical standard between a first position remote from the palletized load and a second position adjacent to the load, and a wipe-down implement pivotally mounted upon the support arm between extended and retracted positions. The wipe-down element is moved to the extended position, and the support arm is moved to the position adjacent to the palletized load, so as to perform a wipe-down operation upon the trailing end portion of the wrapping film disposed upon the palletized load, whereupon conclusion of the wipe-down operation, the wipe-down element is moved to the retracted position before the support arm is returned to the remote position such that the wipe-down implement is disengaged from the trailing end portion adhered upon the palletized load so as not to cause the trailing end portion of the wrapped film to become dislodged from its adhered state upon the wrapped load.

21 Claims, 4 Drawing Sheets

WIPE DOWN BRUSH SYSTEM FOR OVERHEAD STRETCH WRAPPER AND METHOD OF OPERATING THE SAME

FIELD OF THE INVENTION

The present invention relates generally to wrapping film packaging apparatus, and a method of operating the same, and more particularly to a new and improved wipe down brush system, and a method of operating the same, for use in connection with a wrapping film packaging system for wrapping or packaging, for example, palletized loads within wrapping or packaging film.

BACKGROUND OF THE INVENTION

In connection with the wrapping of, for example, palletized loads within wrapping or packaging film, a palletized load is disposed at a film wrapping or packaging station, and a film wrapping or packaging assembly is rotated around the film wrapping or packaging station so as to envelop or wrap the palletized load within wrapping or packaging film. The wrapping or packaging film is conventionally disposed upon a supply roll of wrapping or packaging film, and the supply roll of wrapping or packaging film is mounted upon a vertically movable carriage which, in turn, is mounted upon a rotatable arm of an overall film wrapping or packaging system. Accordingly, if the carriage is moved, for example, vertically downwardly, or is disposed for a predetermined period of time at a predetermined elevational level, while the rotatable arm is rotated around the film wrapping or packaging station, the wrapping or packaging film withdrawn from the supply roll of wrapping or packaging film is able to be wrapped around the palletized load in either a spiral or concentric wrapping or packaging mode so as to completely envelop or encompass the palletized load within the wrapping or packaging film.

The film wrapping or packaging system further conventionally comprises a clamping mechanism for clamping, for example, a leading end of the wrapping or packaging film in preparation for the initiation of a film wrapping or packaging operation or cycle, and a cutter mechanism for severing the wrapping or packaging film at the conclusion of the film wrapping or packaging operation or cycle whereby the wrapping or packaging film wrapped upon the palletized load is able to be separated from the wrapping or packaging film disposed upon the supply roll of wrapping or packaging film. At the beginning of a film wrapping or packaging operation or cycle, the leading end of the wrapping or packaging film is secured to the palletized load in accordance with known wrapping or packaging techniques, and at the conclusion of the film wrapping or packaging operation or cycle, as a result of the severance of the wrapping or packaging film at a predetermined point or location interposed between the palletized load and the supply roll of wrapping or packaging film, a new leading end of the wrapping or packaging film is effectively created in preparation for the initiation of a new film wrapping or packaging operation or cycle to be performed upon a new palletized load, while simultaneously therewith, a trailing end portion of the wrapping or packaging film, which is of course integrally attached to the wrapped or packaged palletized load, is likewise effectively created. It is also conventional to ensure that the trailing end portion of the wrapping or packaging film is in fact secured to the wrapped or packaged palletized load by causing the trailing end portion of the wrapping or packaging film to self-adhere to the previously wrapped layers of the wrapping or packaging film disposed upon the palletized load. This is readily achievable in view of the fact that the chemical composition of the surface portion of the wrapping or packaging film that is disposed toward the load conventionally comprises a suitable tackifier.

In order to therefore ensure that the trailing end portion of the wrapping or packaging film will in fact self-adhere to the previously wrapped layers of the wrapping or packaging film, various auxiliary assemblies or systems, which are known in the industry as wipe down mechanisms, devices, or implements, have been conventionally employed so as to in effect force the trailing end portion of the wrapping or packaging film into engagement with those layers of wrapping or packaging film which have been previously wrapped around the palletized load. Examples of such wipe down mechanisms, devices, or implements are disclosed within U.S. Pat. No. 4,995,224 which issued to Yourgalite et al. on Feb. 26, 1991, U.S. Pat. No. 4,955,181 which issued to Casteel on Sep. 11, 1990, U.S. Pat. No. 4,779,396 which issued to Stackhouse on Oct. 25, 1988, U.S. Pat. No. 4,735,033 which issued to Stackhouse on Apr. 5, 1988, U.S. Pat. No. 4,563,863 which issued to Humphrey on Jan. 14, 1986, and U.S. Pat. No. 4,232,501 which issued to Stackhouse on Nov. 11, 1980.

As can readily be appreciated from the noted patents, each one of the wipe-down system conventionally comprises a wiper mechanism, device, or implement which is usually mounted upon a rotatable or pivotal support arm so as to be capable of moving the wipe-down mechanism, device, or implement between a first relatively remote or retracted position at which the wipe-down mechanism, device, or implement is DISENGAGED from a trailing end portion of the wrapping or packaging film and therefore is not in position to perform a wipe-down operation or procedure in connection with the trailing end portion of the wrapping or packaging film, and a second relatively close or extended position at which the wipe-down mechanism, device, or implement is ENGAGED in contact with the trailing end portion of the wrapping or packaging film and is therefore in position to perform a wipe-down operation or procedure in connection with the trailing end portion of the wrapping or packaging film. As a result of the wipe-down operation or procedure, the trailing end portion of the wrapping or packaging film is forced into contact with, and adhered to, the previously wrapped layers of wrapping or packaging film disposed upon the palletized load, whereby the free trailing end portion of the wrapping or packaging film is no longer disposed in a free-floating state and therefore does not present a potential hazard with respect to subsequent operation of the wrapping or packaging machinery.

While the aforenoted wipe-down mechanisms, devices, or implements have apparently been operationally satisfactory, it is noted that in accordance with the usage of the wipe-down mechanism, device, or implement during a wipe-down operation or procedure, the wipe-down mechanism, implement, or device support arm is rotationally or pivotally moved in the first rotational direction from its remote or retracted DISENGAGED position to its close or extended ENGAGED position so as to permit the wipe-down mechanism, device, or implement to perform or achieve the wipe-down operation or procedure, and upon conclusion of the wipe-down procedure or operation, the wipe-down mechanism, device, or implement support arm is rotationally or pivotally moved in a second opposite direction from its close or extended ENGAGED position back to its remote or retracted DISENGAGED position in preparation for a subsequent wipe-down operation or procedure. It has been experienced, however, that, as a result of the aforenoted return or reversed directional movement of the wipe-down mechanism, device, or implement support arm back to its remote or retracted DISENGAGED position, and as a result of the fact that during such movement of the suppor arm, the wipe-down mechanism, device, or implement per se is still somewhat disposed in contact with the trailing end portion of the wrapping or packaging film adhered to the previously wrapped underlying layers of wrapping or packaging film disposed upon the palletized load, the wipe-down mechanism, device, or implement per se will sometimes cause the trailing end portion of the wrapping or packaging film to become dislodged from its adhered state upon the palletized load. Obviously, such a state or disposition of the trailing end portion of the wrapping or packaging film effectively defeats the entire purpose or objective of employing a wipe-down mechanism, device, or implement, requiring, for example, the wipe-down operation or procedure to be repeated.

A need therefore exists in the art for a new and improved wipe-down mechanism, device, or implement assembly, and a method of operating the same, wherein, for example, the wipe-down mechanism, device, or implement per se can effectively be operatively removed or disengaged from its contact position, with respect to the trailing end of the packaging or wrapping film adhered upon the wrapped or packaged palletized load, prior to the movement of the wipe-down mechanism, device, or implement support arm such that, when the wipe-down mechanism, device, or implement support arm is in fact moved from its close or extended ENGAGED position back to its remote or retracted DISENGAGED position, since the wipe-down mechanism, device, or implement per se has already been operatively disengaged from operative contact with the trailing end of the packaging or wrapping film adhered upon the wrapped or packaged palletized load, movement of the wipe-down mechanism, device, or implement support arm from its close or extended ENGAGED position back to its remote or retracted DISENGAGED position will not result in the wipe-down mechanism, device, or implement per se causing the dislodgment of the trailing end of the packaging or wrapping film from its adhered position upon the wrapped or packaged palletized load.

OBJECTS OF THE INVENTION

Accordingly, it is an object of the present invention to provide a new and improved wipe-down system, and a method of operating the same, for achieving a wipe-down operation or procedure in connection with securely adhering a trailing end portion of a wrapping or packaging film onto a previously wrapped or packaged palletized load.

Another object of the present invention is to provide a new and improved wipe-down system, and a method of operating the same, for achieving a wipe-down operation or procedure in connection with securely adhering a trailing end portion of a wrapping or packaging film onto a previously wrapped or packaged palletized load, whereby the system and method effectively overcome the various operational drawbacks or disadvantages characteristic of PRIOR ART wipe-down systems and methods.

An additional object of the present invention is to provide a new and improved wipe-down system, and a method of operating the same, for achieving a wipe-down operation or procedure in connection with securely adhering a trailing end portion of a wrapping or packaging film onto a previously wrapped or packaged palletized load such that the trailing end portion of the wrapping or packaging film will not be inadvertently dislodged from its adhered position upon the palletized load at the conclusion of the wipe-down operation or procedure.

A further object of the present invention is to provide a new and improved wipe-down system, and a method of operating the same, for achieving a wipe-down operation or procedure for securely adhering a trailing end portion of a wrapping or packaging film onto a previously wrapped or packaged palletized load, wherein the operation or disposition of the wipe-down mechanism, device, or implement per se is controlled independently of the support arm, upon which the wipe-down mechanism, device, or implement is mounted, so as to be capable of movement toward and away from the palletized load independently of the support arm in order to facilitate the achievement of the wipe-down operation or procedure for securely adhering the trailing end portion of a wrapping or packaging film upon the palletized load.

A last object of the present invention is to provide a new and improved wipe-down system, and a method of operating the same, for achieving a wipe-down operation or procedure for securely adhering a trailing end portion of a wrapping or packaging film onto a previously wrapped or packaged palletized load, wherein the operation or disposition of the wipe-down mechanism, device, or implement per se is controlled independently of the support arm, upon which the wipe-down mechanism, device, or implement is mounted, so as to be capable of movement toward and away from the palletized load independently of the support arm in order to facilitate the achievement of the wipe-down operation or procedure whereby the trailing end portion of the wrapping or packaging film will not be inadvertently dislodged from its adhered position upon the palletized load at the conclusion of the wipe-down operation or procedure.

SUMMARY OF THE INVENTION

The foregoing and other objectives are achieved in accordance with the teachings and principles of the present invention through the provision of a new and improved wipe-down system, and method of operating the same, which, in addition to a first actuating mechanism for rotationally or pivotally moving the main support arm, upon which a wipe-down mechanism, device, or implement is operatively mounted, between a first remote or retracted DISENGAGED position and a second close or extended ENGAGED position, there is provided a second actuating mechanism for actuating the wipe-down mechanism, device, or implement per se between a first DISENGAGED position and a second ENGAGED position. In this manner, upon conclusion of a wipe-down operation or procedure, the second actuating mechanism would be actuated such that the wipe-down mechanism, device, or implement per se is operatively moved from its ENGAGED position to its DISENGAGED position whereby the wipe-down mechanism, device, or implement per se is no longer disposed in contact with the trailing end of the wrapping or packaging film which is now secured in an adhered state upon the wrapped or packaged palletized load, and subsequently, the first actuating mechanism would be actuated so as to move the wipe-down mechanism, device, or implement support arm from its close or extended ENGAGED position to its remote or retracted DISENGAGED position. In this manner, as a result of the actuation of the second actuating means for moving the wipe-down mechanism, device, or implement per se to its DISEN- GAGED position, at which the wipe-down mechanism, device, or implement per se is no longer disposed in contact with the trailing end portion of the wrapping or packaging film, prior to the actuation of the first actuating means for moving the wipe-down mechanism, device, or implement support arm from its close or extended ENGAGED position to its remote or retracted DISENGAGED position, the movement of the wipe-down mechanism, device, or implement support arm from its close or extended ENGAGED position to its remote or retracted DISENGAGED position cannot cause the wipe-down mechanism, device, or implement per se to cause dislodgment of the trailing end portion of the wrapping or packaging film, previously adhered upon the wrapped or packaged palletized load, from the wrapped or packaged palletized load. Accordingly, the operational objectives of the wipe-down procedure will be ensured.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
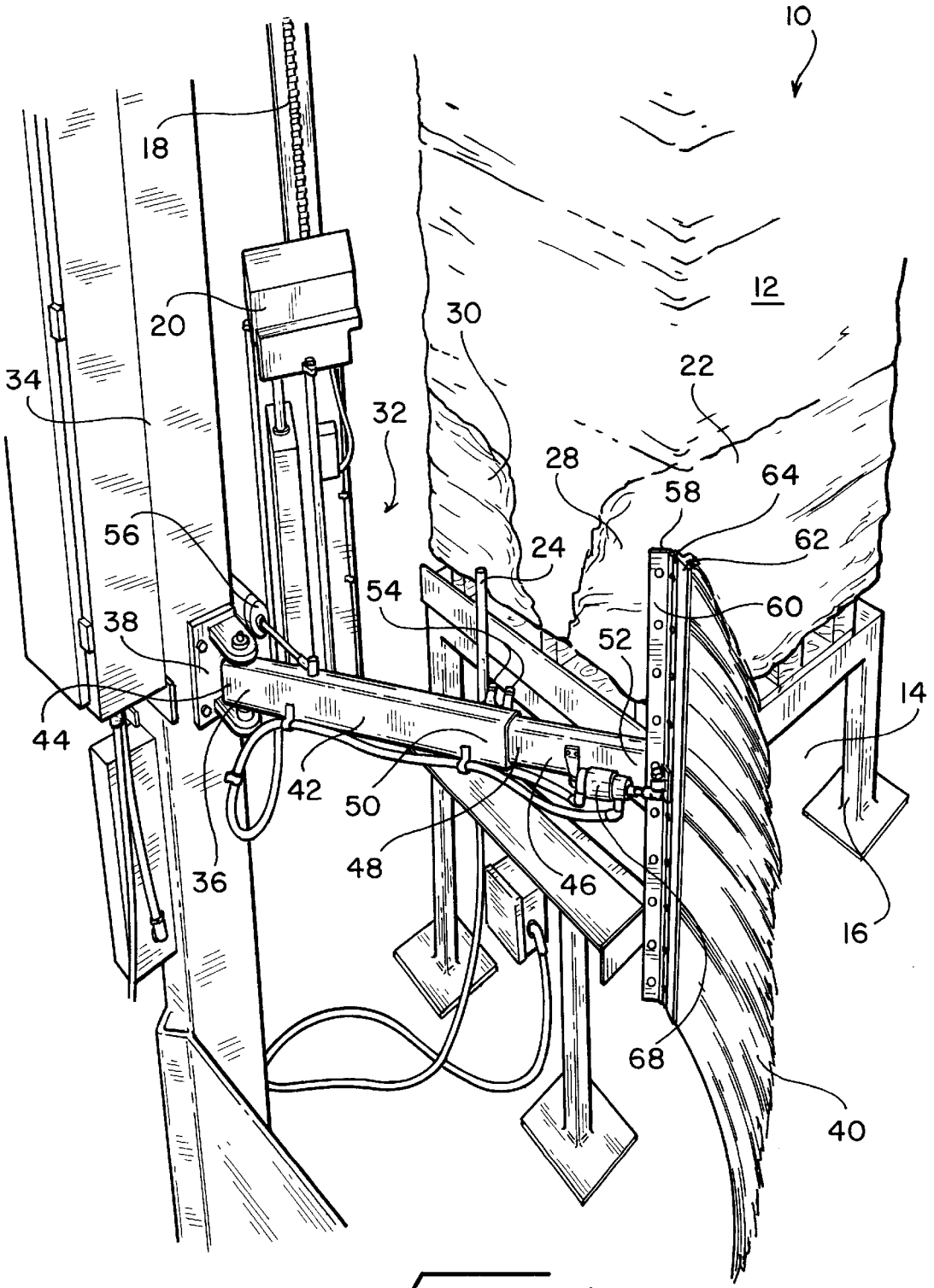
FIG. 1 is a perspective view showing some of the operating components of a system, apparatrus, or machine for wrapping or packaging a palletized load within wrapping or packaging film and having incorporated therein a new and improved wipe-down brush system constructed in accordance with the principles and teachings of the present invention and showing the cooperative parts thereof.

Referring now to the drawings, and more particularly to FIG. 1 thereof, a new and improved film wrapping or packaging system, apparatus, or machine, for wrapping or packaging a palletized load within wrapping or packaging film, is disclosed and is generally indicated by the reference character 10. The palletized load is disclosed at 12 and is disposed, for example, at a wrapping station 14 which is defined in effect by means of a palletized load support framework 16. The film wrapping or packaging system 10 is seen to further comprise a vertically disposed or oriented downright 18 upon which a film dispensing carriage assembly is vertically reciprocable as is known in the art. The film dispensing carriage assembly 20 has a supply roll, not shown, of wrapping or packaging film, operatively associated therewith and mounted thereon, from which wrapping or packaging film, having a leading end portion thereof operatively secured to the palletized load 12, is withdrawn during a film wrapping or packaging operation. The vertically oriented downright 18 and the film dispensing carriage assembly 20 are also mounted upon a horizontally rotatable arm or ring member, not shown, whereby as the vertically oriented down-right 18 and the film dispensing carriage assembly 20 are effectively rotated around the wrapping station 14 and the palletized load 12 disposed thereat, the palletized load 12 is wrapped, packaged, or enveloped within the wrapping or packaging film as disclosed at 22.

Figure 4:
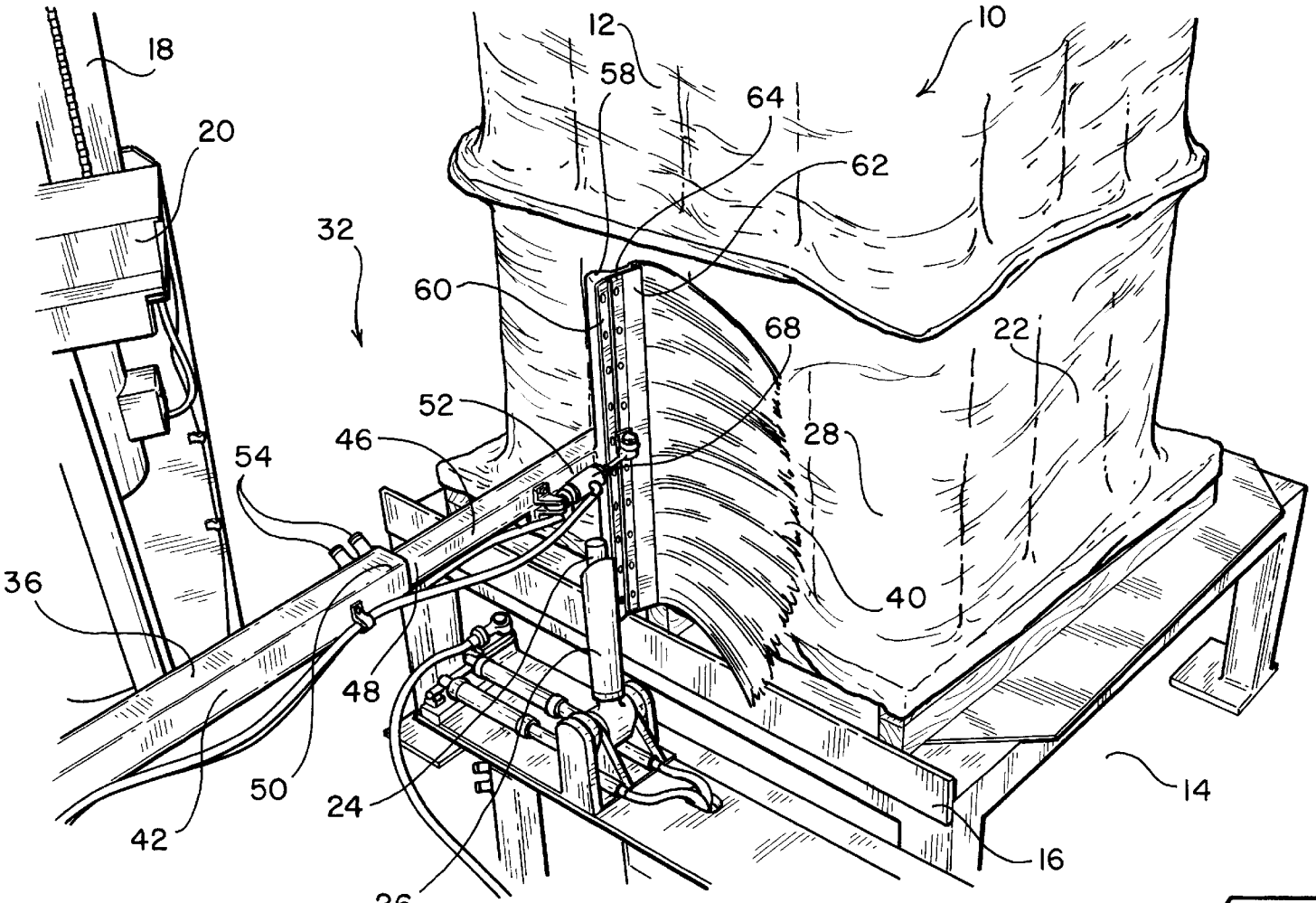
FIG. 4 is a perspective view similar to that of FIG. 1 showing, however, the new and improved wipe-down brush system, apparatus, or system wherein the wipe-down implement support arm has been actuated from its remote or retracted DISENGAGED position to its close or extended ENGAGED position such that the wipe-down brush implement is capable of performing a wipe-down operation or procedure upon a trailing end portion of wrapping or packaging film previously wrapped around a palletized load.

At the conclusion of a film wrapping or packaging operation, and as is conventional within the film wrapping or packaging industry, it is desirable to sever the wrapping or packaging film, which extends from the wrapped or packaged palletized load 12 back to the supply roll, not shown, of wrapping or packaging film disposed upon the carriage assembly 20, so as to enable separation of the wrapped or packaged palletized load 12 from the wrapping or packaging apparatus or system 10, and in order to effectively prepare the wrapping or packaging apparatus or system 10 for a new subsequent palletized load wrapping or packaging operation. Accordingly, a clamping mechanism, partially shown in FIG. 1 and shown entirely within FIG. 4, is actuated so as to effectively grasp a portion of the wrapping or packaging film which is interposed between the wrapped or packaged palletized load 12 and the carriage assembly 20. The clamping mechanism comprises what is called or known in the industry as a "hot-dog and bun" type clamping mechanism in view of the fact that the structural components of the clamping mechanism together resemble a hot dog disposed within a bun. More particularly, as best seen in FIG. 4, the clamping mechanism comprises a clamping rod 24 and a semi-tubular clamping member 26 which partially surrounds or envelops substantially one half of the clamping rod 24, both of which are movable between vertically upwardly projecting operative positions and horizontally disposed inoperative positions. The clamping rod 24 and the semi-tubular clamping member 26 are separately activated by suitable means controlled by means of a suitable programmable logic control (PLC) system, not shown, such that, for example, the clamping rod 24 is initially pivotally actuated to its operative upward position so as to be disposed upon one side of the aforenoted portion of the wrapping or packaging film, and subsequently, the semi-tubular clamping member 26 is pivotally actuated to its operative upward position so as to be disposed upon the opposite side of the wrapping or packaging film portion whereby the wrapping or packaging film portion is effectively entrapped or clamped between the clamping rod 24 and the semi-tubular clamping member 26.

Subsequently, a cutter mechanism, not shown, is activated or energized so as to sever a portion of the wrapping or packaging film disposed adjacent to the clamped portion of the wrapping or packaging film. As a result of such severance operation by means of the cutter mechanism, not shown, a trailing end portion of the wrapping or packaging film, which is integrally attached to the wrapped or packaged palletized load, is formed as disclosed at 28 in FIG. 1, and a leading end portion of the wrapping or packaging film, which is similar to that shown at 30 in FIG. 1 and which is integrally attached to the supply roll, not shown, of wrapping or packaging film disposed upon the carriage assembly 20, is likewise simultaneously formed for initiating a film wrapping or packaging operation to be performed upon a new palletized load. As has been noted hereinbefore, in order to finally conclude or terminate the entire film wrapping or packaging operation with respect to the palletized load 12, it is desirable at this stage of the film wrapping or packaging operation to ensure that the trailing end portion 28 of the wrapping or packaging film is truly adhered to and secured upon the wrapped or packaged palletized load 12, and accordingly, the new and improved wipe-down mechanism or implement assembly 32, constructed in accordance with the principles and teachings of the present invention, is to be utilized.

More particularly, as can be appreciated from FIGS. 1–4, but as can best be appreciated from FIG. 1, the new and improved wipe-down mechanism or implement assembly 32 is seen to comprise a vertically oriented fixed standard or mast member 34 upon which a first end of a wipe-down mechanism or implement support arm 36 is pivotally mounted, for movement within a substantially horizontal plane, by means of a suitable hinge mechanism or assembly 38. The distal or remote end of the support arm 36 has a wipe-down implement, in the form of a brush 40, mounted thereon, and it is further appreciated that the support arm 36 actually comprises a two-piece, axially or longitudinally adjustable support arm assembly such that the disposition of the wipe-down brush implement 40 may, for example, be adjustably positioned with respect to differently sized palletized loads. More specifically, the support arm assembly 36 comprises a first tubular support arm member 42 which has its proximal end 44 pivotally mounted upon the standard or mast 34 by means of the hinge assembly 38, and a second tubular support arm member 46 which is adjustably mounted upon the first tubular support arm member 42. The proximal end 48 of the second tubular support arm member 44 is slidably disposed within the open distal end 50 of the first tubular support arm member 42, and the distal end 52 of the second tubular support arm member 44 has the wipe-down brush implement 40 mounted thereon. A pair of set screws 54 are operatively mounted upon the distal end portion 50 of the first tubular support arm member 42 so as to operatively engage the proximal end portion 48 of the second tubular support arm member 44 in order to fixedly maintain the relative disposition of the second tubular support arm member 44 with respect to the first tubular support arm member 42 once the second tubular support arm member 44 has been positionally axially or longitudinally adjusted with respect to the first tubular support arm member 42.

It is further noted that the support arm assembly 36, and the wipe-down brush implement 40 mounted thereon, are adapted to be pivotally moved between a first relatively remote location or position, as disclosed, for example, within FIG. 1, at which the wipe-down brush implement 40 is disposed out of contact with, or is DISENGAGED from, the palletized load 12 and the trailing end portion 28 of the wrapping or packaging film 12 disposed upon the palletized load 12, and a second relatively close or adjacent location or position, as disclosed, for example, within FIG. 4, at which the wipe-down brush implement 40 is disposed in contact, or ENGAGED, with the trailing end portion 28 of the wrapping or packaging film 12 disposed upon the palletized load 12 so as to be capable of performing a wipe-down operation or procedure. Consequently, in order to achieve such pivotal movements of the support arm assembly 36 and the wipe-down brush implement 40 mounted thereon, a first suitable actuating mechanism 56, which may be a double-acting pneumatic cylinder assembly, is mounted upon the upstanding mast or standard and is operatively connected to the support arm assembly 36 as seen in FIG. 1.

With reference continuing to be made to FIGS. 1–4, it is further seen that a first wipe-down implement mounting bracket 58 is fixedly attached to the distal end portion 52 of the second tubular support arm member 46 so as to be disposed transversely to the longitudinal axis or extent of the support arm assembly 36, and in accordance with the unique and novel structure or system comprising the wipe-down mechanism or system of the present invention, the wipe-down brush implement 40 is adapted to be pivotally mounted upon the support arm assembly 36. Accordingly, a first hinge member 60, which may comprise, for example, a conventional piano-type hinge mechanism, is fixedly mounted upon the first mounting bracket 58. The wipe-down brush implement 40 comprises a second wipe-down implement mounting bracket 62, and the second wipe-down implement mounting bracket 62 is fixedly mounted upon a second hinge member 64 which is hingedly connected, and pivotally movable with respect, to the first hinge member 60. As can best be appreciated from FIGS. 2 and 3, as a result of the aforenoted hinged mounting of the wipe-down brush implement 40 upon the support arm assembly 36, the wipe-down brush implement 40 is adapted to be pivotally moved between a first retracted DISENGAGED position, as disclosed within FIG. 3, at which the second wipe-down implement mounting bracket 62 and the second hinge member 64 are disposed substantially perpendicular to the first hinge member 60, and a second extended ENGAGED position, as disclosed within FIG. 2, at which the second wipe-down implement mounting bracket 62 and the second hinge member 64 are disposed substantially parallel to or coplanar with the first hinge member 60. In order to achieve such pivotal movements of the wipe-down brush implement 40, the second wipe-down implement mounting bracket 62, and the second hinge member 64 with respect to the first hinge member 60 and the first wipe-down implement mounting bracket 58, a second double-acting pneumatic cylinder assembly 66 is mounted upon the second tubular support arm member 46 and is operatively connected to the second hinge member 64. More specifically, as may best be seen from FIG. 2, the second double-acting pneumatic cylinder assembly 66 comprises a cylinder portion 68 which is fixedly mounted upon the second tubular support arm member 46 by means of a suitable mounting bracket 70, and an extensible/contractible piston rod member 72 which has its distal end portion operatively connected to the second hinge member 64 by means of a suitable pin and bracket assembly 74. Pneumatic control lines for the second double-acting pneumatic cylinder assembly 66 are disclosed at 76.

In operation, during the performance of a palletized load wrapping or packaging operation or cycle, the first double-acting pneumatic cylinder assembly 56 is actuated so as to move the support arm assembly 36 to its remote or retracted position whereby the wipe-down brush implement 40 is normally disposed at its DISENGAGED position with respect to the palletized load 12. Upon conclusion of the palletized load wrapping or packaging operation or cycle, wherein the palletized load 12 is completely wrapped or packaged within the wrapping or packaging film, and no further layers of the wrapping or packaging film are to be wrapped around the palletized load 12, the hot dog and bun clamping members 24,26 are actuated so as to clamp a portion of the wrapping or packaging film therebetween, and the cutter mechanism, not shown, is subsequently actuated so as to sever a portion of the wrapping or packaging film at a location immediately adjacent to the clamping members 24,26 and thereby effectively create leading and trailing end portions of the wrapping or packaging film. At this point in time, it is therefore desired that the free-floating trailing end portion 28 of the wrapping or packaging film be smoothly and securely adhered to the wrapped or packaged palletized load 12.

Figure 2:
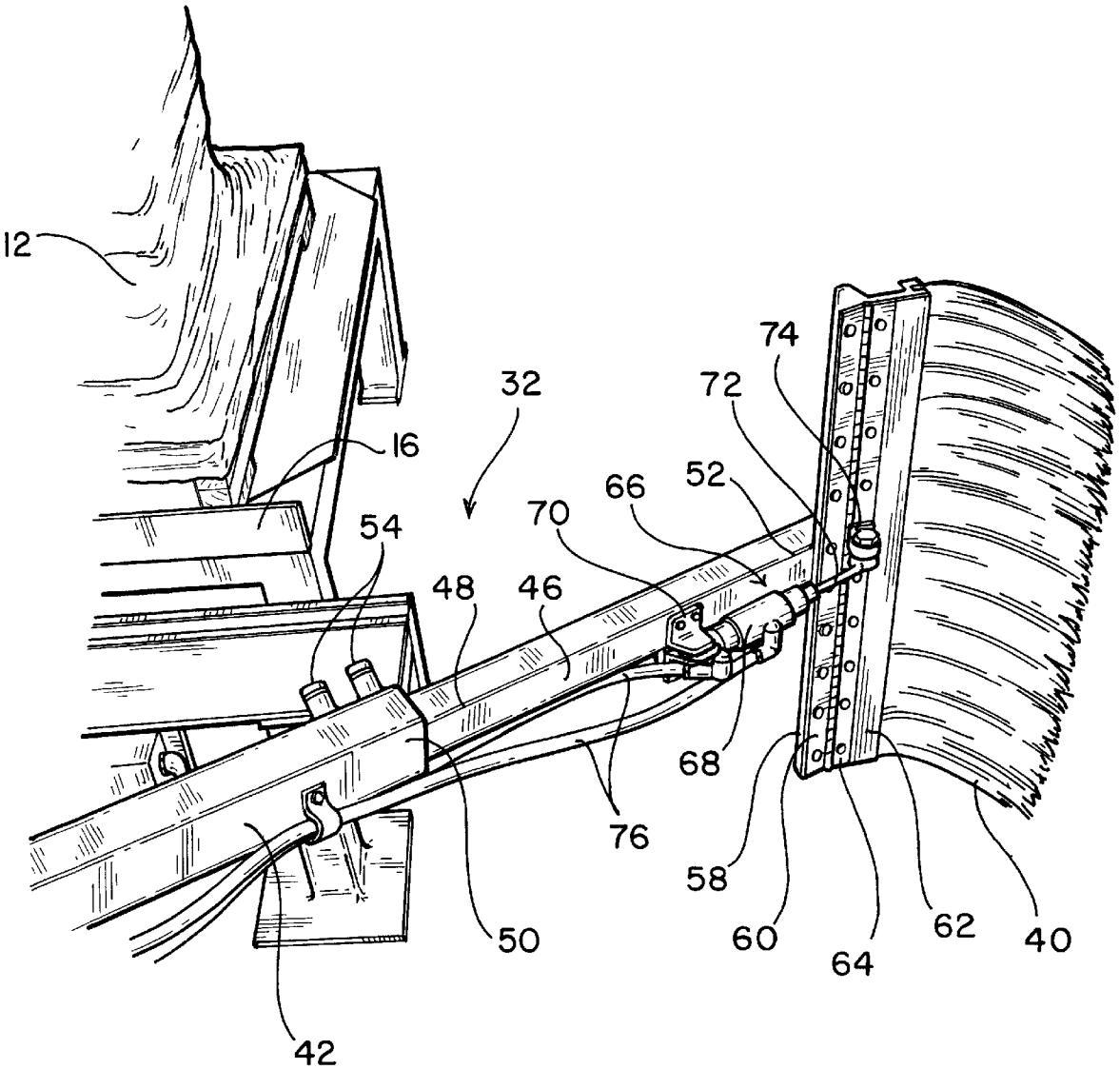
FIG. 2 is a perspective view of the new and improved wipe-down brush system, apparatus, or machine as disclosed within FIG. 1 and showing the wipe-down brush implement thereof disposed in its extended, operative ENGAGED wipe-down mode or position wherein the mounting base of the wipe-down brush implement is disposed substantially parallel to the axis of the wipe-down implement support arm.
Figure 3:
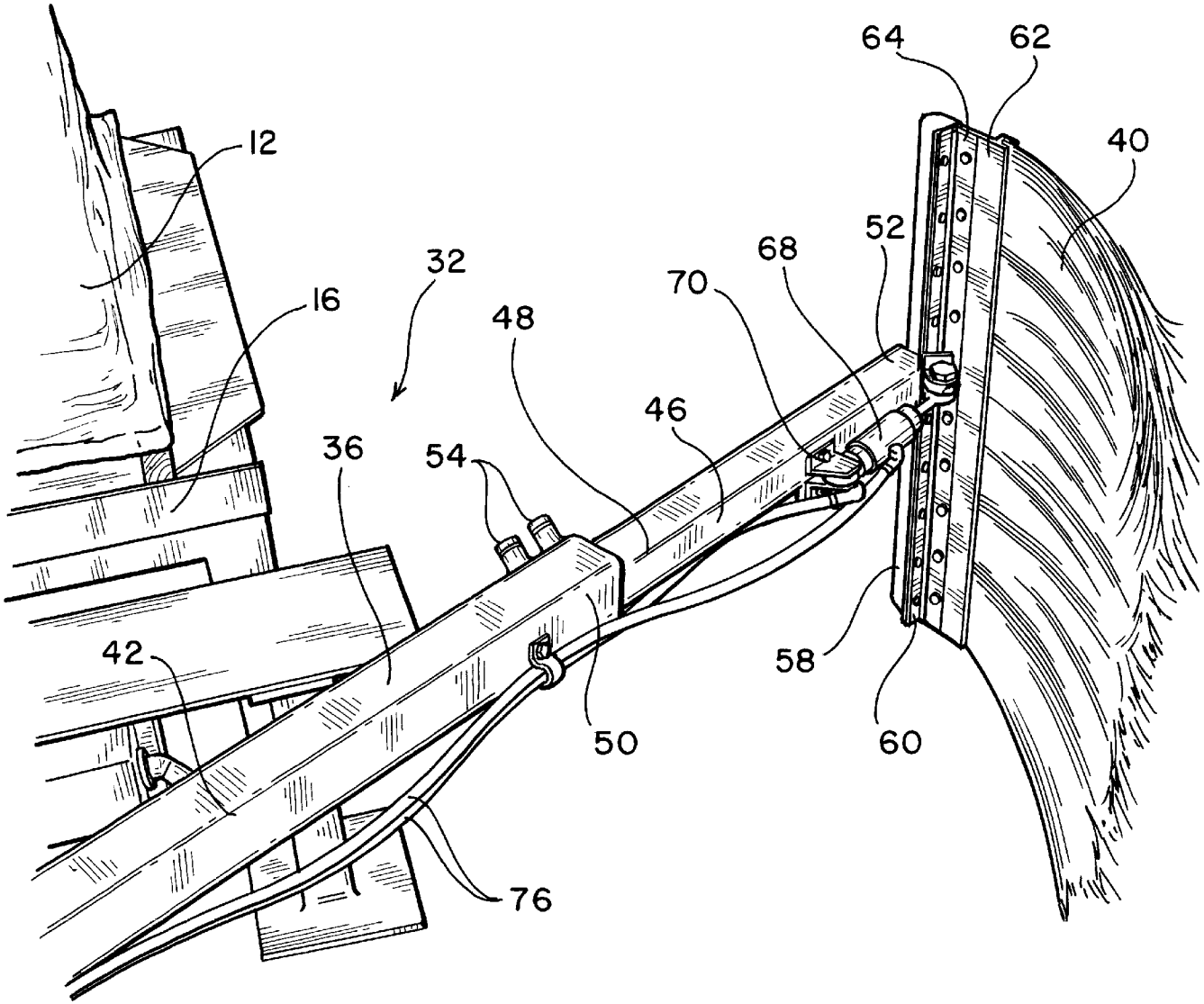
FIG. 3 is a perspective view similar to that of FIG. 2 showing, however, the new and improved wipe-down brush system, apparatus, or machine wherein the wipe-down brush implement incorporated therein is disposed in its retracted, inoperative DISENGAGED mode or position wherein the mounting base of the wipe-down brush implement is disposed substantially perpendicular to the axis of the wipe-down implement support arm.

Accordingly, the second double-acting pneumatic cylinder assembly 66 will be actuated so as to move the wipe-down brush implement 40, its mounting bracket 62, and its hinge member 64 from their positions shown in FIG. 3, wherein the mounting bracket 62 and the second hinge member 64 are disposed substantially perpendicular to the first hinge member 60, to their positions shown in FIG. 2 wherein the mounting bracket 62 and the second hinge member 64 are disposed substantially parallel or coplanar with respect to the first hinge member 60, in preparation for movement of the support arm assembly 36 from its relatively remote or retracted position with respect to the palletized load 12, as shown in FIG. 1, to its relatively close or extended position with respect to the palletized load 12 as shown in FIG. 4, in accordance with the performance of a wipe-down operation. Accordingly, the first double-acting pneumatic cylinder assembly 56 is actuated, by means, for example, of the aforenoted programmable logic control (PLC) system, not shown, so as to in fact move the support arm assembly 36 from its relatively remote or retracted position with respect to the palletized load 12, as shown in FIG. 1, to its relatively close or extended position with respect to the palletized load 12 as shown in FIG. 4. As a result of such movement, and as can be readily appreciated from FIG. 4, the wipe-down implement brush 40 performs its wipe-down operation upon the trailing edge portion 28 of the wrapping or packaging film whereby the trailing edge portion of the wrapping or packaging film is in fact adhered to the previously wrapped layers disposed upon the palletized load 12.

At the conclusion of the wipe-down operation, whereby the support arm assembly 36 is still disposed, for example, at its extended position as shown in FIG. 4 whereby, in turn, the wipe-down implement brush 40 is likewise still disposed at its ENGAGED state with respect to the palletized load 12, then if the first double-acting pneumatic cylinder assembly 56 was now actuated so as to return the support arm assembly 36 back to its retracted position as shown in FIG. 1, a potential risk is encountered that the wipe-down implement brush would cause the trailing edge portion 28 of the wrapping or packaging film, which is now adhered to the palletized load 12, to become dislodged from the palletized load 12 whereby the wipe-down operation would be compromised. In accordance with the principles and teachings of the present invention, however, prior to the actuatiuon of the first double-acting pneumatic cylinder assembly 56 so as to return the support arm assembly 36 back to its retracted position as shown in FIG. 1, the second double-acting pneumatic cylinder assembly 66 is actuated so as to pivotally move the wipe-down implement brush 40, its mounting bracket 62, and its hinge member 64 from their positions shown in FIG. 2, wherein the mounting bracket 62 and the second hinge member 64 are disposed substantially parallel to or coplanar with respect to the first hinge member 60, to their positions shown in FIG. 3 wherein mounting bracket 62 and the second hinge member 64 are disposed substantially perpendicular to the first hinge member 60. In this manner, the wipe-down implement brush 40 is moved from its extended position, by means of which it is disposed in contact with the palletized load 12 so as to be ENGAGED therewith, to its retracted position by means of which it is no longer disposed in contact with the palletized load 12 and is therefore DISENGAGED therefrom.

Accordingly, when the first double-acting pneumatic cylinder assembly 56 is then actuated so as to return the support arm assembly 36 from its extended position as shown in FIG. 4 back to its retracted position as shown in FIG. 1, in view of the fact that the wipe-down implement brush 40 has already been operatively disengaged from the palletized load 12, the wipe-down implement brush 40 cannot engage the trailing end portion 28 of the wrapping or packaging film and therefore cannot inadvertently and undesirably cause the trailing end portion 28 of the wrapping or packaging film to become dislodged from the wrapped or packaged palletized load 12. The wipe-down assembly 32 is therefore again ready for a new or subsequent wipe-down operation to be performed upon a new or subsequently wrapped or packaged palletized load. It is to be noted that in accordance with one preferred mode of operation as just described, the wipe-down implement brush 40, its mounting bracket 62, and its hinge member 64 were moved from their positions shown in FIG. 3, wherein the mounting bracket 62 and the second hinge member 64 are disposed substantially perpendicular to the first hinge member 60, to their positions shown in FIG. 2, wherein mounting bracket 62 and the second hinge member 64 are disposed substantially parallel to or coplanar with the first hinge member 60, just prior to the movement of the support arm assembly from the retracted DISENGAGED position of FIG. 1 to the extended ENGAGED position of FIG. 4, and just prior to the initiation of a wipe-down operation or cycle.

However, as an alternative mode of operation, the wipe-down implement brush 40, its mounting bracket 62, and its hinge member 64 can be moved from their positions shown in FIG. 3 to their positions shown in FIG. 2 at the end of the previous wipe-down operation or cycle such that upon initiation of a subsequent wipe-down operation or cycle, the wipe-down implement brush 40 is already properly positioned or oriented for performing the wipe-down operation. In either case, the critical factor or mode of operation to be achieved is the disposition or orientation of the wipe-down implement brush 40 at the position shown in FIG. 2 prior to the movement of the support arm assembly 36 from the position shown in FIG. 1 to the position shown in FIG. 4 and prior to the initiation of the wipe-down operation so that the wipe-down operation can be properly performed, and the disposition or orientation of the wipe-down implement brush 40, upon the conclusion of the wipe-down operation, at the position shown in FIG. 3 and prior to the movement of the support arm assembly 36 from the position shown in FIG. 4 to the position shown in FIG. 1 so that the wipe-down implement brush 40 does not encounter the trailing edge portion 28 of the wrapping or packaging film already adhered upon the palletized load 12 and thereby cause dislodgment of the trailing edge portion 28 of the wrapping or packaging film from the palletized load 12.

Thus, it may be seen that in accordance with the principles and teachings of the present invention, there has been provided a new and improved wipe-down implement assembly or system by means of which the inadvertent and undesirable dislodgment of the trailing edge portion of the wrapping or packaging film, already adhered upon the wrapped or packaged palletized load, will be effectively prevented. More particularly, by effectively disengaging the wipe-down implement brush from the trailing edge portion of the wrapping or packaging film adhered upon the palletized load prior to movement of the support arm assembly, upon which the wipe-down implement brush is mounted, from its extended position adjacent the palletized load to its retracted position remote from the palletized load, the wipe-down implement brush cannot engage the trailing edge portion of the wrapping or packaging film already adhered upon the palletized load and thereby cause dislodgment of the trailing edge portion of the wrapping or packaging film from the palletized load.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A wipe-down implement system for ensuring adherence of a trailing end portion of a wrapping film, wrapped around a load disposed at a wrapping station, at the conclusion of a film wrapping operation, comprising:

a fixed support;

a support arm movably mounted upon said fixed support between a first position at which said support arm is disposed remote from the load disposed at the wrapping station, and a second position at which said support arm is disposed adjacent to the load disposed at the wrapping station;

a wipe-down implement, movably mounted upon said support arm between a first retracted position and a second extended position, for ensuring adherence of a trailing end portion of a wrapping film, withdrawn from a roll of wrapping film and wrapped around a load disposed at the wrapping station, to the wrapped load at the conclusion of a load wrapping operation;

first actuating means interconnecting said support arm to said fixed support for moving said support arm between said first position at which said support arm is disposed remote from the load disposed at the wrapping station, and said second position at which said support arm is disposed adjacent to the load disposed at the wrapping station; and second actuating means interconnecting said wipe-down implement to said support arm for moving said wipe-down implement from said first retracted position to said second extended position prior to said support arm being disposed at said second position adjacent to the load disposed at the wrapping station such that when said support arm is moved by said first actuating means from said first position remote from the load disposed at the wrapping station to said second position adjacent to the load disposed at the wrapping station, said wipe-down implement will be engaged with the load disposed at the wrapping station so as to perform a wipe-down operation in connection with the trailing edge portion of the wrapping film wrapped around the load disposed at the wrapping station whereby the trailing end portion of the wrapping film will be adhered to the wrapped load disposed at the wrapping station, and for moving said wipe-down implement from said second extended position to said first retracted position while said support arm is disposed at said second position adjacent to the load disposed at the wrapping station and prior to said support arm being moved by said first actuating means from said second position adjacent to the load disposed at the wrapping station to said first position remote from the load disposed at the wrapping station such that said wipe-down implement will be disengaged from the load disposed at the wrapping station whereby when said support arm is moved by said first actuating means from said second position adjacent to the load disposed at the wrapping station to said first position remote from the load disposed at the wrapping station, said wipe-down implement will not dislodge the adhered trailing edge portion of the wrapping film from the load disposed at the wrapping station.

2. The system as set forth in claim 1, wherein:

said support arm is pivotally mounted upon said fixed support; and said wipe-down implement is pivotally mounted upon said support arm.

3. The system as set forth in claim 1, wherein:

said first and second actuating means respectively comprise double-acting pneumatic cylinder assemblies.

4. The system as set forth in claim 1, wherein:

said wipe-down implement comprises a wipe-down brush.

5. The system as set forth in claim 1, further comprising:

a mounting bracket fixedly mounted upon said support arm;

a first hinge member fixedly mounted upon said mounting bracket;

a second hinge member, upon which said wipe-down implement is fixedly mounted, hingedly connected to said first hinge member; and said second actuating means interconnects said second hinge member to said support arm.

6. The system as set forth in claim 5, wherein:

said second hinge member is disposed substantially perpendicular to said first hinge member when said wipe-down implement is disposed at said first disengaged position with respect to the load disposed at the wrapping station; and said second hinge member is disposed substantially coplanar with respect to said first hinge member when said wipe-down implement is disposed at said second engaged position with respect to the load disposed at the wrapping station.

7. The system as set forth in claim 1, wherein:

said support arm comprises a two-piece support arm assembly comprising a first arm member pivotally connected to said fixed support, and a second arm member upon which said wipe-down implement is mounted;

said second arm member being adjustably mounted upon said first arm member so as to adjustably position said wipe-down implement with respect to the load disposed at the wrapping station.

8. The system as set forth in claim 7, wherein:

said first arm member comprises a tubular member;

said second arm member is movably disposed within said first tubular arm member; and set screw means mounted upon said first arm member for operatively engaging said second arm member so as to fixedly retain said second arm member at adjusted positions with respect to said first arm member.

9. A film wrapping system for wrapping a film around a load disposed at a wrapping station, comprising:

a downright member;

a carriage mechanism, upon which a roll of wrapping film is disposed, movably mounted upon said downright member;

a fixed support;

a support arm movably mounted upon said fixed support between a first position at which said support arm is disposed remote from the load disposed at the wrapping station, and a second position at which said support arm is disposed adjacent to the load disposed at the wrapping station;

a wipe-down implement, movably mounted upon said support arm between a first retracted position and a second extended position, for ensuring adherence of a trailing end portion of a wrapping film, withdrawn from a roll of wrapping film and wrapped around a load disposed at the wrapping station, to the wrapped load at the conclusion of a load wrapping operation;

first actuating means interconnecting said support arm to said fixed support for moving said support arm between said first position at which said support arm is disposed remote from the load disposed at the wrapping station, and said second position at which said support arm is disposed adjacent to the load disposed at the wrapping station; and second actuating means interconnecting said wipe-down implement to said support arm for moving said wipe-down implement from said first retracted position to said second extended position prior to said support arm being disposed at said second position adjacent to the load disposed at the wrapping station such that when said support arm is moved by said first actuating means from said first position remote from the load disposed at the wrapping station to said second position adjacent to the load disposed at the wrapping station, said wipe-down implement will be engaged with the load disposed at the wrapping station so as to perform a wipe-down operation in connection with the trailing edge portion of the wrapping film wrapped around the load disposed at the wrapping station whereby the trailing end portion of the wrapping film will be adhered to the wrapped load disposed at the wrapping station, and for moving said wipe-down implement from said second extended position to said first retracted position while said support arm is disposed at said second position adjacent to the load disposed at the wrapping station and prior to said support arm being moved by said first actuating means from said second position adjacent to the load disposed at the wrapping station to said first position remote from the load disposed at the wrapping station such that said wipe-down implement will be disengaged from the load disposed at the wrapping station whereby when said support arm is moved by said first actuating means from said second position adjacent to the load disposed at the wrapping station to said first position remote from the load disposed at the wrapping station, said wipe-down implement will not dislodge the adhered trailing edge portion of the wrapping film from the load disposed at the wrapping station.

10. The system as set forth in claim 9, wherein:

said support arm is pivotally mounted upon said fixed support; and said wipe-down implement is pivotally mounted upon said support arm.

11. The system as set forth in claim 9, wherein:

said first and second actuating means respectively comprise double-acting pneumatic cylinder assemblies.

12. The system as set forth in claim 9, wherein:

said wipe-down implement comprises a wipe-down brush.

13. The system as set forth in claim 9, further comprising:

a mounting bracket fixedly mounted upon said support arm;

a first hinge member fixedly mounted upon said mounting bracket;

a second hinge member, upon which said wipe-down implement is fixedly mounted, hingedly connected to said first hinge member; and said second actuating means interconnects said second hinge member to said support arm.

14. The system as set forth in claim 13, wherein:

said second hinge member is disposed substantially perpendicular to said first hinge member when said wipe-down implement is disposed at said first disengaged position with respect to the load disposed at the wrapping station; and said second hinge member is disposed substantially coplanar with respect to said first hinge member when said wipe-down implement is disposed at said second engaged position with respect to the load disposed at the wrapping station.

15. The system as set forth in claim 9, wherein:

said support arm comprises a two-piece support arm assembly comprising a first arm member pivotally connected to said fixed support, and a second arm member upon which said wipe-down implement is mounted;

said second arm member being adjustably mounted upon said first arm member so as to adjustably position said wipe-down implement with respect to the load disposed at the wrapping station.

16. The system as set forth in claim 15, wherein:

said first arm member comprises a tubular member;

said second arm member is movably disposed within said first tubular arm member; and set screw means mounted upon said first arm member for operatively engaging said second arm member so as to fixedly retain said second arm member at adjusted positions with respect to said first arm member.

17. A method of using a wipe-down implement for ensuring adherence of a trailing end portion of a wrapping film, wrapped around a load disposed at a wrapping station, at the conclusion of a film wrapping operation, comprising the steps of:

mounting a support arm upon a fixed support such that said support arm is movable between a first position remote from the load disposed at the wrapping station, and a second position adjacent to the load disposed at the wrapping station;

mounting a wipe-down implement upon said support arm such that said wipe-down implement is movable between a first retracted position and a second extended position;

disposing said support arm at said first remote position with respect to the load disposed at the wrapping station while a film wrapping operation is being performed upon the load disposed at the wrapping station;

disposing said wipe-down implement at said second extended position when said support arm is disposed at said first remote position with respect to the load disposed at the wrapping station;

performing a film wrapping operation upon the load disposed at the wrapping station;

severing a portion of the wrapping film, attached to the load disposed at the wrapping station, at the conclusion of the film wrapping operation so as to create a trailing end portion of the wrapping film wrapped around the load disposed at the wrapping station;

moving said support arm, at the conclusion of the film wrapping operation, from said first position, remote from the load disposed at the wrapping station, to said second position adjacent to the load disposed at the wrapping station such that said wipe-down implement, disposed at said second extended position, engages the trailing end portion of the wrapping film wrapped around the load disposed at the wrapping station so as to perform a wipe-down operation upon the trailing end portion of the wrapping film and thereby cause the trailing end portion of the wrapping film to be adhered to the wrapped load disposed at the wrapping station;

moving said wipe-down implement from said second extended position to said first retracted position after said wipe-down implement has performed said wipe-down operation while said support arm is disposed at said second position adjacent to the load disposed at the wrapping station; and moving said support arm from said second position, adjacent to the load disposed at the wrapping station, to said first position remote from the load disposed at the wrapping station whereby as a result of the movement of said wipe-down implement from said second extended position to said first retracted position prior to said movement of said support arm from said second position, adjacent to the load disposed at the wrapping station, to said first position remote from the load disposed at the wrapping station, said wipe-down implement cannot engage the trailing edge portion of the wrapping film adhered to said load disposed at the wrapping station, while said support arm is moved from said second position, adjacent to the load disposed at the wrapping station, to said first position remote from the load disposed at the wrapping station, so as not to dislodge the adhered trailing edge portion of the wrapping film from the load disposed at the wrapping station.

18. The method as set forth in claim 17, further comprising the steps of:

fixedly mounting a bracket upon said support arm;

fixedly mounting a first hinge member upon said support arm bracket;

hingedly connecting a second hinge member, upon which said wipe-down implement is fixedly mounted, to said first hinge member;

disposing said second hinge member substantially perpendicular to said first hinge member when said wipe-down implement is disposed at said first retracted position with respect to the load disposed at the wrapping station; and disposing said second hinge member substantially coplanar with respect to said first hinge member when said wipe-down implement is disposed at said second extended position with respect to the load disposed at the wrapping station.

19. The method as set forth in claim 17, further comprising the steps of:

providing said support arm as a two-piece support arm assembly comprising a first arm member pivotally connected to said fixed support, and a second arm member upon which said wipe-down implement is mounted;

adjustably mounting said second arm member upon said first arm member so as to adjustably position said wipe-down implement with respect to the load disposed at the wrapping station.

20. The method as set forth in claim 19, further comprising the steps of:

forming said first arm member as a tubular member;

movably positioning said second arm member within said first tubular arm member to different positions; and using set screw means, mounted upon said first arm member, to operatively engage said second arm member so as to fixedly retain said second arm member at an adjusted position with respect to said first arm member.

21. The method as set forth in claim 17, further comprising the step of:

respectively moving said support arm and said wipe-down implement between said first and second positions by double-acting pneumatic cylinder assemblies.

* * * * *